US005279000A

United States Patent [19]

Mercier et al.

[11] Patent Number: 5,279,000

[45] Date of Patent: Jan. 18, 1994

[54] AUTOMATIC TOILET SEAT LOWERING HINGE ASSEMBLY

[76] Inventors: William H. Mercier, 264 Lichtfield Ave., Elmont, N.Y. 11003; Roger R. Mercier, Oakridge Dr., Brooklyn, Conn. 06234

[21] Appl. No.: 974,615

[22] Filed: Nov. 12, 1992

[51] Int. Cl.[5] ..... A47K 13/12

[52] U.S. Cl. ..... 4/240; 4/248; 4/246.1; 4/246.2

[58] Field of Search ..... 4/248, 246.1, 246.2, 4/240; 188/306, 307

[56] References Cited

U.S. PATENT DOCUMENTS

| | | | |
|---|---|---|---|
| 1,318,052 | 10/1919 | Carter | 188/307 |
| 1,369,946 | 3/1921 | Tibbetts | 188/307 |
| 1,970,369 | 8/1934 | Focht | 188/306 |
| 4,491,989 | 1/1985 | McGrail | 4/246.1 |
| 4,723,639 | 2/1988 | Hungerford | 188/307 |
| 4,914,757 | 4/1990 | Johnson | 4/248 |
| 5,153,946 | 10/1992 | Yoke et al. | 4/248 |

*Primary Examiner*—Henry J. Recla
*Assistant Examiner*—Charles R. Eloshway
*Attorney, Agent, or Firm*—Galgano & Burke

[57] ABSTRACT

An automatic toilet seat lowering hinge assembly for automatically lowering a toilet seat from a raised position to a lower position above the toilet seat includes a housing having a chamber through which a shaft is disposed therein. The shaft is releasibly attached to the toilet seat. The housing has a baffle extending from the inner surface of the housing to the surface of the shaft and a descent paddle extends from the shaft outwardly toward the inner surface of the housing to partition the chamber into two compartments. A vent controls the transfer of fluid between the partitioned chamber compartments so that the toilet seat pivots from the raised position to the lower position in a predetermined amount of time.

9 Claims, 3 Drawing Sheets

AUTOMATIC TOILET SEAT LOWERING HINGE ASSEMBLY

BACKGROUND OF THE INVENTION

The present invention relates generally to toilet seat hinges. More particularly, this invention relates to a toilet seat hinge assembly which allows the toilet seat to automatically return to a horizontal or lowered position from a vertical or raised position via controlled hydraulic operation.

Generally, toilets are designed with a toilet seat having a hinge which allows the toilet seat to be manually pivoted between either a lowered position or a raised position for use. Many discussions and even heated arguments have arisen between the male and female population, particularly couples and family members, regarding the position the toilet seat should remain when in not in use. Specifically, many female individuals feel adamant that in residential homes the toilet seat should remain in the lowered position. This requires male individuals after use of the toilet as a urinal to be conscious of manually pivoting the toilet seat to its lowered position.

Numerous devices have been invented in an effort to try to solve the above mentioned problem. For example, U.S. Pat. No. 4,402,092, granted to Smallwood, discloses a spring mechanism wherein a spring is placed in torsion about a hinge shaft when a user manually moves the toilet seat to its use position. The spring acts either to upright a lowered toilet seat or to lower a raised toilet seat. The angular rotation of the toilet seat is slowed by the hinge shaft having a large gear engaging a small gear on an idler shaft with the rotation of the idler shaft braked by a slipping clutch.

Another example, U.S. Pat. No. 4,551,866, to Hibbs, discloses an automatic toilet seat lowering device having a lever mechanism attached to the toilet seat and to a piston which moves in an operating cylinder. Movement of the toilet seat compresses a biasing spring which urges the piston to return the toilet seat to the lowered position. The piston operates on a fluid in the cylinder to delay the lowering of the toilet seat. See also U.S. Pat. No. 454,743, to Kremelberg.

Another example, U.S. Pat. No. 4,491,989, to McGrail, discloses a closure device for toilet seats which includes a spring-biased latching lever which is activated by the flushing handle of the toilet and dampening device. The dampening device is mounted to one hinge of the toilet cover and includes a housing that rotates about a stationary hinge pin when the toilet seat or toilet seat and cover is raised or lowered. The hinge pin has a passage or bore which acts on air in the housing to delay the lowering of the toilet cover or toilet cover and toilet seat.

A further example, U.S. Pat. No. 4,995,120, to Tager, discloses a toilet seat closing device incorporating a reversible DC electric motor controlled by either an electronic circuit timer or a manual remote control device.

Other inventions for toilet seats include automatic lifting devices for lifting toilet seats from a lowered position to a raised position. For example, U.S. Pat. No. 4,951,323, to Shalom, uses a spring mechanism, whereas U.S. Pat. No. 2,092,707, to Zulkoski, uses a manual hydraulically operated foot pedal.

While satisfactory, the prior art devices all have certain significant disadvantages. Some are unreliable and cumbersome to use; others are complicated and expensive in construction and difficult to install on a standard or conventional toilet. In addition, some of these devices also require electrical power supplies, batteries or plumbing hookups, and they do not afford a variable rate descent control.

SUMMARY OF THE INVENTION

Accordingly, it is an object of the present invention to provide an improved toilet seat lowering hinge assembly which automatically returns a manually raised toilet seat to a lowered position after use of the toilet as a urinal by a male individual.

It is also an object of the present invention to provide such a toilet seat lowering hinge assembly which controls the rate of pivotable descent of the toilet seat when the toilet seat is automatically lowered from a raised position to a lowered position.

It is a further object of the present invention to provide such a toilet seat lowering hinge assembly which prevents inconvenience to female individuals who prefer that the toilet seat remain in the lowered position when the toilet is not in use.

It is another object of the present invention to provide such a toilet seat lowering hinge assembly wherein the automatic lowering of the toilet seat can be overridden by a user manually applying downward pressure on the toilet seat.

It is still another object of the present invention to provide such a toilet seat lowering apparatus that is highly efficient, relatively simple in design and construction, compact, unnoticeable, economical to manufacture and readily adaptable to conventional standard toilets.

It is still yet another object of the present invention to provide such a toilet seat lowering hinge assembly that is easily installed by an individual homeowner.

Certain of the foregoing and related objected are readily attained in a toilet seat lowering hinge assembly for automatically lowering a toilet seat from a raised position to a lowered position above the toilet bowl which includes a tubular housing having an inner surface defining a chamber and a shaft sealingly disposed through the housing generally spaced from the inner surface thereof and pivotably mounted thereon for movement between the raised and lowered positions. An operating fluid is received in said chamber and means are provided for releasibly securing one of the housing and the shaft to the toilet bowl. Means are also provided for releasibly securing the shaft to the toilet seat so that the shaft and the toilet seat pivot together. A baffle is disposed in the housing extending from the inner surface of the housing to the shaft and a descent paddle is fixedly attached to the shaft which extends radially outward to sealingly engage the housing inner surface, thereby cooperating with the baffle, inner surface and shaft to partition the chamber into two compartments disposed on opposite sides of the paddle. Vent means are associated with at least one of the baffle and the paddle for allowing operating fluid to flow therethrough from one compartment to the other compartment of the chamber so as to allow the toilet seat to pivot from the raised position to the lowered position at a predetermined rate of time. Manual override means are also associated with at least one of the paddle and the baffle for permitting the toilet seat to be manually moved quickly from the raised position to the lowered position.

Preferably, the assembly further includes a one-way valve means in at least one of the baffle and the paddle for permitting the seat to be quickly pivoted from the lowered to the raised position. The one-way valve means desirably comprises a flap valve having a cover pivotally attached to one side of either the baffle or the paddle.

Most desirably, the housing is cylindrical. Most advantageously, the vent means comprises a vent hole formed in the baffle.

In a preferred embodiment of the invention, the assembly additionally includes vent hole adjustment means for adjusting the size of the vent hole.

Most desirably, the manual override means comprises a flexible sealing strip attached to the paddle which normally engages the inner surface of the housing, but which flexes and allows the operating fluid to pass from one compartment to the other when the toilet seat is manually lowered from the raised to the lowered position. Alternatively, the manual override means comprises one-way valve means associated with one of the baffle and the paddle which is normally closed but which opens and allows the operating fluid to pass from one compartment to the other when the toilet seat is manually lowered from the raised to the lowered position.

BRIEF DESCRIPTION OF THE DRAWING FIGURES

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
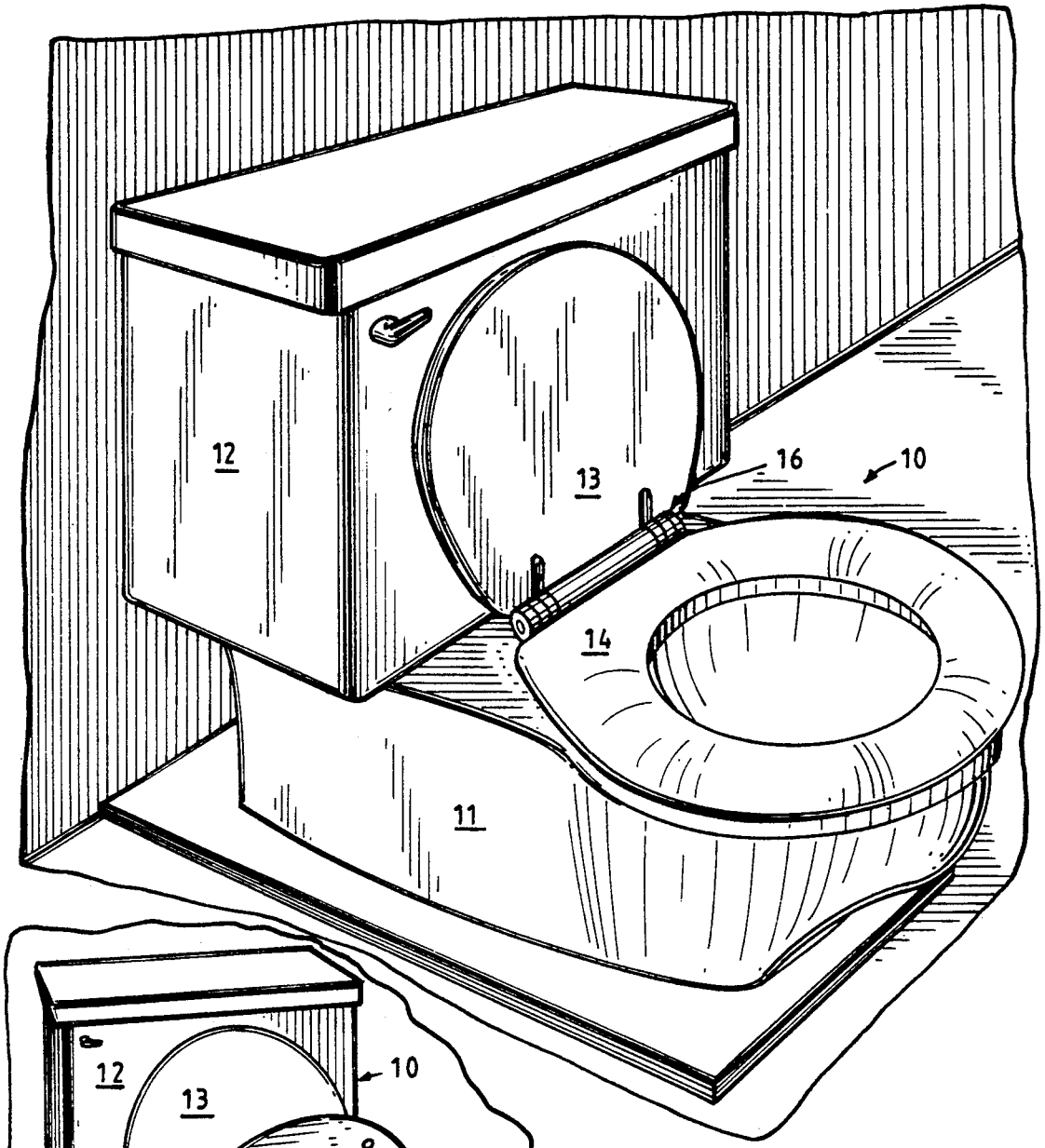
FIG. 1 is a perspective view of the automatic toilet seat lowering hinge assembly embodying the present invention installed on a conventional toilet, showing the toilet seat in its lowered position.
Figure 2:
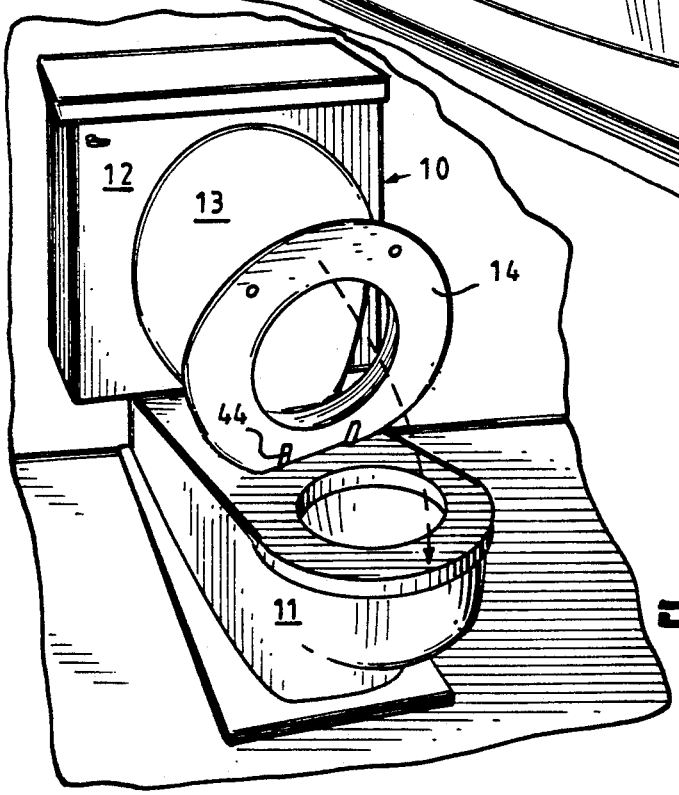
FIG. 2 is a perspective view of the toilet seat lowering hinge assembly installed on a toilet, showing the toilet seat in the process of automatically pivoting from a raised position to a lowered position.

Turning now in detail to the drawing, and in particular to FIG. 1, therein illustrated is an automatic toilet seat lowering apparatus or hinge assembly 16 embodying the present invention which is installed on a conventional toilet 10 having a toilet bowl 11, water tank 12, a toilet seat cover 13 and a toilet seat 14. In residential homes it is generally preferred that the toilet seat 14 be maintained in a horizontal or lowered position when not in use. Often times the seat is raised to a vertical position, particularly by male individuals when using the toilet as a urinal, and after use not returned a lowered position. Referring to FIG. 2 there is illustrated a toilet 10 wherein the toilet seat 14 has been raised to the vertical position and is in the transition of returning in a controlled manner to a lowered position via hinge assembly 16, as described in greater detail hereinafter.

Figure 3:
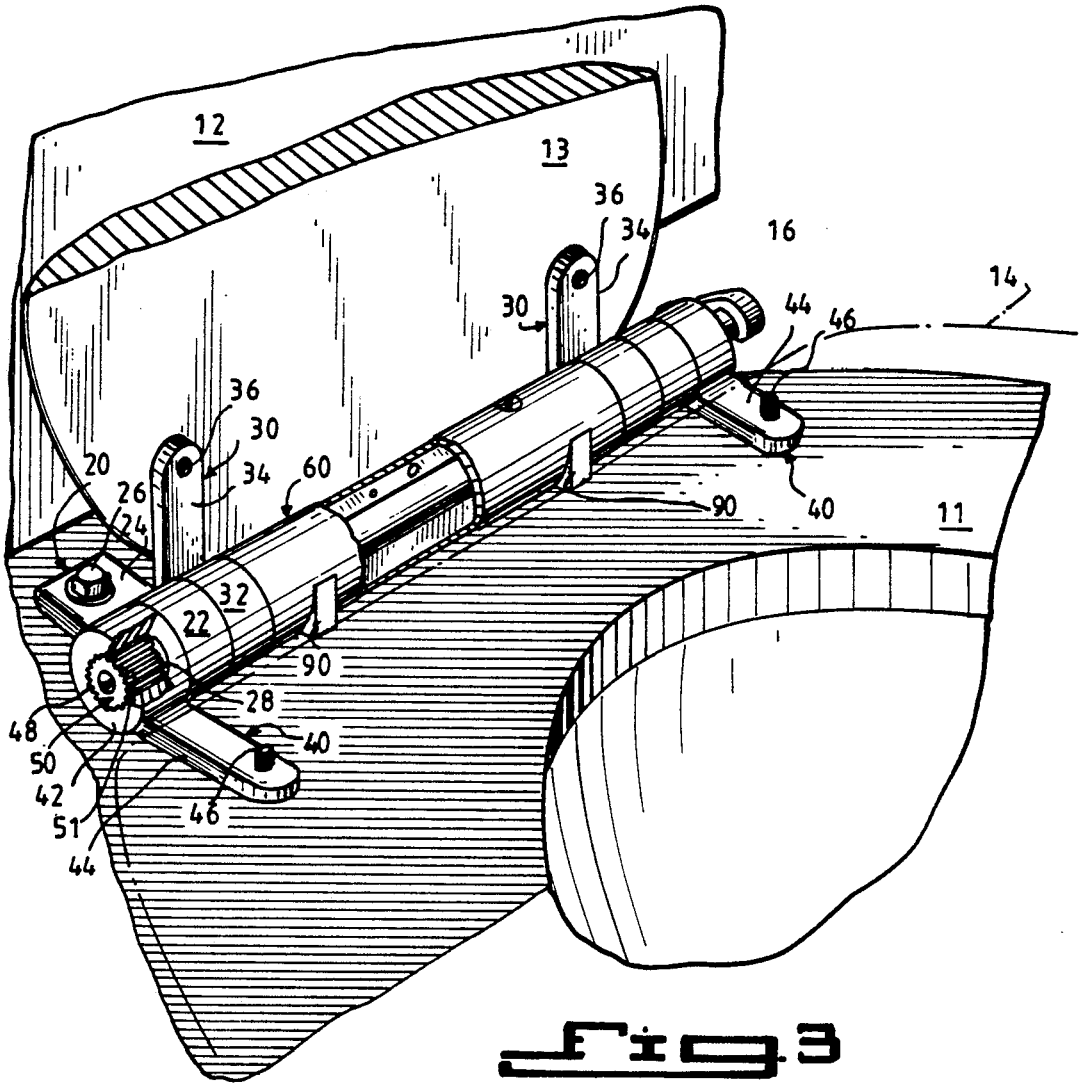
FIG. 3 is an enlarged, fragmentarily-illustrated perspective view, with portions broken away, of the automatic toilet seat lowering hinge assembly, showing the toilet seat in phantom.
Figure 4:
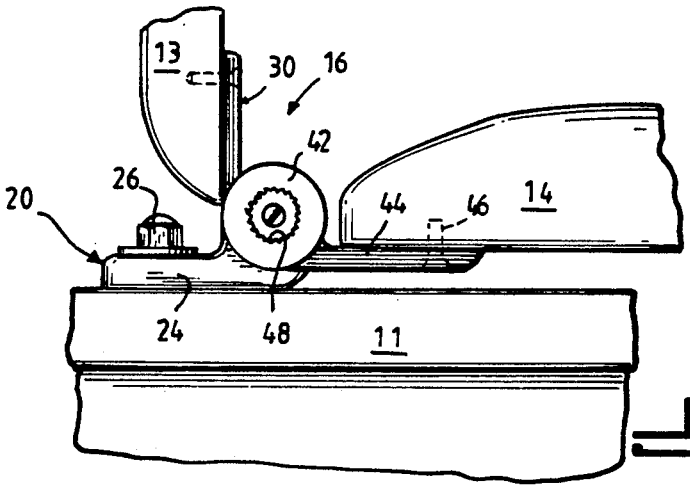
FIG. 4 is an enlarged, fragmentarily-illustrated, side elevational view of the toilet seat lowering hinge assembly showing the attachments to the toilet, toilet seat and toilet cover.

With reference to FIGS. 3 and 4, hinge assembly 16, generally includes toilet bowl mounting brackets 20, toilet cover brackets 30, toilet seat brackets 40, and a pivotable shaft 50, the middle section of which is received within a housing 60. The pair of mounting brackets 20 secures hinge assembly 16 to the toilet bowl 11. Specifically, mounting bracket 20 has a ring shaped collar or bearing section 22 (FIG. 3) and an integrally formed lug section 24 (FIG. 4) having a hole through which a standard bolt 26 can pass and attach to the conventional standardized holes in the toilet bowl 11. Ring shaped bearing section 22 has a bore 28 (FIG. 3) which supports and permits shaft 50 to freely rotate therein.

Referring again to FIGS. 3 and 4, a pair of toilet cover brackets 30 secures the toilet cover 13 to shaft 50. Each cover bracket 30 has a ring shaped collar or bearing section 32 which has a bore (not shown) similar to mounting bracket bore 28 which is mounted for free rotation on shaft 50. Integrally formed with the bearing section 32 is a lug section 34 having a hole through which a screw 36 can pass and attach to holes in the toilet seat cover 13. The toilet seat cover 13 is freely rotatable on shaft 50 allowing the seat cover 13 to act independently of the toilet seat 14.

A pair of toilet seat brackets 40 attach the toilet seat 14 to shaft 50. Specifically, each toilet seat bracket 40 has a ring shaped bearing section 42 and an integrally formed lug section 44. Lug section 44 has a hole by which a screws 46 can pass for attachment to the toilet seat 14. The ring shaped bearing 42 has a bore with number of teeth 48 for corresponding engagement with teeth 51 (FIG. 3) on the ends of shaft 50. Other conventional, well-known attachment means could equally be employed to rigidly attach the toilet seat 14 to the shaft 50, such as a set screw. The rigid attachment between toilet seat 14 and shaft 50 causes shaft 50 to pivot or rotate when toilet seat 14 is pivoted between a raised and a lowered position.

Figures 5A, 5B, 6, 7, 8, 9A, 9B:
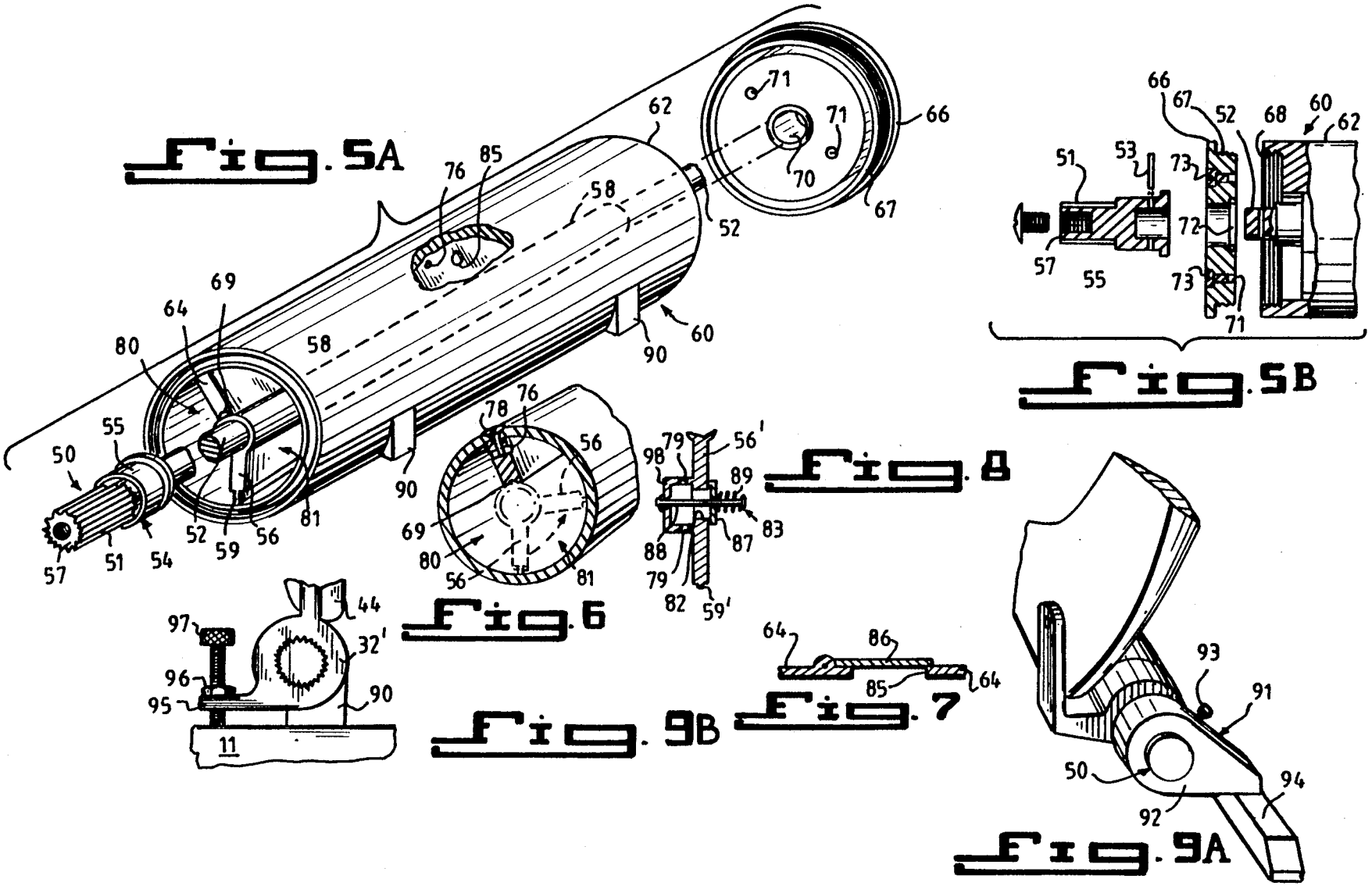
FIG. 5A is an enlarged, exploded perspective view, with portions broken away, of the housing and shaft.
FIG. 5B is a fragmentarily-illustrated, longitudinal sectional view, in part elevation, of the end of the housing and shaft showing the end caps and end fittings.
FIG. 6 is an enlarged, fragmentarily-illustrated perspective view of the housing showing the baffle, flow rate adjustment screw and, in phantom, movement of the paddle from the lowered to the raised position.
FIG. 7 is an enlarged, side elevational view of the one-way valve.
FIG. 8 is an enlarged, side elevational view of another embodiment of the paddle.
FIG. 9A is a fragmentarily-illustrated, side perspective view of the hinge assembly showing one embodiment of the toilet seat stop.
FIG. 9B is a fragmentarily-illustrated, elevational end view of the hinge assembly showing another embodiment of the toilet seat stop.

Referring now to FIGS. 5A and 5B, shaft 50 includes a rod 52, a pair of end fittings 54, and a descent paddle 56. Rod 52 extends through housing 60. End fittings 54 fixedly attach to the ends of rod 52 by a locking pin 53. The end fittings 54 each have a bearing surface 55 (shown slightly reduced in dimension in comparison to FIG. 3) which corresponds to the bearing surface in the cover bracket 30 and mounting bracket 20. The distal end 57 contains teeth 51 for corresponding engagement with teeth 48 in the toilet seat bracket 40.

Paddle 56 is attached axially along the major portion of rod 52, which is contained inside the housing 60 via a paddle sleeve 58 affixed to rod 52 (except for the ends of rod 52) and which extends axially outwardly therefrom. The distal end of the paddle 56 contains a flexible, resilient, centrally-disposed tip seal 59 which serves two functions. It forms a seal against the inner surface of the housing 60, but it is sufficiently flexible to bend under sufficient pressure to allow fluid to transfer from one side of the paddle to the other, as discussed below.

Referring once again to FIG. 5A and 5B, housing 60 includes a hollow cylindrical tube 62, a baffle 64 and a pair of end caps 66 threadably attached to the ends of the tube 62. Specifically, the radial edge of each end cap 66 has external threads 67 which correspond with internal threads 68 on the inner surface of the ends of tube 62. The end caps 66 further have a central bore 70 dimensioned so that the ends of rod 52 pass therethrough and one of the end caps 66 also has two fluid fill holes 71 normally closed via screws 73. An O-ring 72 is disposed in each end cap 66 circling bore 70 to form a tight seal which prohibits fluid transmission therethrough.

Baffle 64 acts as a barrier or wall and attaches to the inner surface of the tube 62 and extends radially to rod 52 dividing the housing into two chambers 80 and 81. The end of baffle 64 is contoured to match the outer diameter of the paddle sleeve 58, and its lower end is channeled to receive a seal strip or gasket 69 along its length. As shown in FIG. 6, a descent relief or vent hole 76 extends through the wall of baffle 64 and allows fluid communication between chambers 80 and 81. A threaded needle valve 78 is threadably received through cylinder tube 62 and baffle 64, so as to intersect vent hole 76. By adjusting needle valve 78, the amount of fluid transmission through vent hole 78 can be adjusted to, in turn, control the rate of descent of seat 14, as described in greater detail hereinafter.

Additional fluid transmission is permitted via larger vent hole 85 in one direction which corresponds to fluid moving from chamber 81 to 80 which reduces the force in raising toilet seat 14. As shown in FIG. 7, this is accomplished by a one-way flap valve 86 pivotably mounted on baffle 64 on the chamber 80 side thereof. Flap valve 86 is made from a resilient strip of material (or it could be spring-loaded) so it normally covers vent hole 85. Its operation is discussed below.

FIG. 8 illustrates a modified construction of the paddle 56, which in place of the flexible tip 59, simply has a sealing tip 59' which serves solely a sealing function. Paddle 56' is provided with a spring-loaded, one-way valve 83 for providing a manual override of the controlled descent. The one-way valve 83 includes a generally U-shaped support 98 having side vent openings 79 and a central opening which receives a pin 88 which extends through vent hole 82 and into the chamber 81. A spring-loaded valve cover plate 87 is received on pin 88 on the chamber 81 side of hole 82 so that it is normally biased against hole 82, thereby preventing fluid transmission therethrough. However, as the toilet seat 14 is lowered quickly, shaft 50 will be rotated and paddle 56' will, in turn, move downwardly (in the direction opposite to that of the arrow in FIG. 6). Due to the increasing fluid pressure in chamber 80, the spring force will be overcome, and the valve cover 87 will open and move away from vent hole 82, thereby allowing fluid into chamber 81, thereby permitting the seat to be lowered quickly.

As seen best in FIG. 5A, a pair of feet 90 are attached to the outer surface of the cylinder tube 62 adjacent the bottom for resting on the toilet bowl 11 and prohibiting the cylinder from turning with respect to the shaft 50 and toilet seat 14. Alternatively, instead of the feet 90, the mounting brackets 20 which attach to the shaft 50 could instead attach to the housing 60.

A fluid, preferably a liquid, is contained within housing 60 and acts as a biasing means allowing the toilet seat 14 to slowly fall from a raised position to a lowered position. Most advantageously, oil is used. However, air, water, or other fluid medium could also be employed. Fluid is added via fill holes 71, normally closed by screws 73, in end cap 66 for filling each compartment 80, 81 with fluid.

FIGS. 9A and 9B illustrate two embodiments of stops for preventing the toilet seat 14 from moving past its vertical upper portion. This is necessary so that the seat will tend to fall under the influence of gravity; typically, a stop angle of 3°-5° off vertical is sufficient for this purpose. As shown in FIG. 9A, a vertical stop 91 has a collar 92 fixed to shaft 50 via set screw 93, and it has a stop arm 94 preventing the toilet seat 14 from rotating past its uppermost vertical point, stop arm 94 engaging the toilet bowl 11 as shaft 50 is pivoted to an "up" or raised position. As can be appreciated, the exact orientation of the seat 14 can be adjusted by adjusting the fixed position of collar 92 relative to shaft 50 via adjustment screw 93. In FIG. 9B, an alternate embodiment is disclosed. In this case, collar 32' replaces collar 32, to which toilet seat 14 is secured. Collar 32' is provided with an extension lug 95 having a bore in which a threaded nut 96 is fixedly mounted which, in turn, receives a threaded adjustment thumbscrew 97. By adjusting the effective length of the lower end of thumbscrew 97 below lug 95, the degree to which the toilet seat 14 can be raised can be controlled, its lower end acting as a stop by abutting toilet bowl 11 to prevent further upward pivoting of toilet seat 14.

The operation of the present invention will be explained with respect to FIGS. 3 and 5A. In FIG. 3, the automatic toilet seat lowering hinge assembly 16 is shown in the lowered position. Housing 60 is positioned so that baffle 64 is slightly rearward of vertical with respect to the toilet 10. Shaft 50 is positioned so that descent paddle 56 is positioned in a generally downwardly extending orientation when the seat is in the lowered position. Adjustment of the position of the descent paddle 56 is accomplished by rotating the teeth 48 of the toilet seat brackets 40 with respect to teeth 51 of shaft 50.

When the toilet seat 14 is raised from the lowered position to a raised position the descent paddle 56 will correspondingly pivot and sweep about the inside of the tube 62 in the direction toward the baffle 64 (see arrow in FIG. 6). Fluid in the chamber 81 is forced through vent openings 76, 85 (largely through the latter and one-way flap valve 86) into chamber 80. Once the seat 14 is rotated to its uppermost raised position (slightly forward of vertical) as defined by stop 91, gravity will act on the toilet seat 14 causing it to pivot downwardly about shaft 50 as it falls to the seated position. The fluid acts to bias toilet seat 14 from pivoting too quickly by causing the fluid to pass through the descent hole 76 (hole 85 being blocked by flap valve 86). The angular speed of the toilet seat is slower while it initially starts its descent, since the torque on the toilet seat 14 is smaller due to the small moment arm, whereas the speed is greater as the toilet seat pivots downward and the moment arm increases. The threaded needle valve 78 can be threadably adjusted to, in turn, adjust the size of the vent hole 76 so as to allow the toilet seat to move from a vertical position to a seated position in about two (2) to three (3) minutes.

The toilet seat 14 can also be quickly moved to its lower position by manually applying a small pressure downward on the toilet seat 14. This will cause tip seal 59 to flex and allow fluid to pass through bypassing the vent hole 76 and allowing the toilet seat 14 to be quickly lowered. The same effect can be accompanied by the use of the one-way valve 83 shown in FIG. 8.

Various modifications can be made, as will become apparent to those skilled in the art. For example, various one-way valves of well-known design could be substituted for the one-way valves illustrated. In addition, although the various parts are preferably made from plastic materials, other materials or combinations thereof could, of course, be employed.

Accordingly, while only several embodiments of the present invention has been shown and described, it is to be understood that many changes and modifications may be made thereunto without departing from the spirit and scope of the invention as disclosed herein.

What is claimed is:

1. A toilet seat lowering hinge assembly for automatically lowering a toilet seat from a raised position to a lowered position above the toilet bowl via controlled hydraulic operation, comprising:

a cylindrical housing having an inner surface defining a chamber;

a shaft sealingly disposed through said housing generally spaced from said inner surface thereof and pivotably mounted on said housing for movement between said raised and lowered positions;

an operating fluid received in said chamber;

means for releasibly securing said hosing to the toilet bowl;

means for releasibly securing said shaft to the toilet seat so that said shaft and said toilet seat are pivoted together;

a baffle fixedly attached to the inner surface of said housing and extending from said inner surface of said housing to said shaft in sealing engagement therewith;

a descent paddle fixedly attached to said shaft and extending radially outward to sealingly engage said housing inner surface, thereby cooperating with said baffle, inner surface and shaft to partition said chamber into two separate compartments disposed on opposite sides of said paddle;

vent means associated with at least one of said baffle and said paddle for allowing said operating fluid to flow therethrough from one compartment to the other compartment of said chamber so as to allow said toilet seat to automatically pivot from the raised position to the lowered position at a predetermined rate of time, said automatic pivoting of said seat being self-initiated under the force of gravity and the weight of the raised seat;

stop means for preventing said toilet seat from pivoting beyond a plane substantially adjacent a vertical plane extending through said shaft; and manual override means associated with at least one of said paddle and said baffle for permitting the toilet seat to be manually moved from the raised position to the lowered position.

2. The hinge assembly according to claim 1, additionally including one-way valve means in at least one of said baffle and said paddle for permitting the seat to be quickly pivoted from the lowered to the raised position.

3. The hinge assembly according to claim 2, wherein said one-way valve means comprises a flap valve.

4. The hinge assembly according to claim 3, wherein said flap valve has a cover pivotally attached to one side of either said baffle and said paddle.

5. The hinge assembly according to claim 4, wherein said flap valve is attached to said baffle.

6. The hinge assembly according to claim 1, wherein said vent means comprises a vent hole formed in said baffle.

7. The hinge assembly according to claim 1, wherein said assembly additionally includes vent hole adjustment means for adjusting the size of said vent hole.

8. The hinge assembly according to claim 1, wherein said manual override means comprises a flexible sealing strip in the form of a narrow blade attached to the end of said paddle which normally engages said inner surface of said housing, but which flexes and bends and allows said operating fluid to pass from one compartment to the other when said toilet seat is manually lowered from said raised to said lowered position.

9. The hinge assembly according to claim 1, wherein said manual override means comprises a one-way valve means associated with one of said baffle and said paddle which is normally closed but which opens and allows said operating fluid to pass from one compartment to the other when said toilet seat is manually lowered from said raised to said lowered position.

* * * * *